United States Patent [19]

Piatti

[11] Patent Number: 4,815,274

[45] Date of Patent: Mar. 28, 1989

[54] EXHAUST SYSTEMS FOR MULTI-CYLINDER INTERNAL COMBUSTION ENGINES

[75] Inventor: Sanzio P. V. Piatti, London, United Kingdom

[73] Assignee: Vincent Patents Limited, London, England

[21] Appl. No.: 901,537

[22] PCT Filed: Nov. 18, 1985

[86] PCT No.: PCT/GB85/00525

§ 371 Date: Jul. 21, 1986

§ 102(e) Date: Jul. 21, 1986

[87] PCT Pub. No.: WO86/03256

PCT Pub. Date: Jun. 5, 1986

[30] Foreign Application Priority Data

Nov. 19, 1984 [GB] United Kingdom ..... 8429212

[51] Int. Cl.[4] ..... F02B 27/02

[52] U.S. Cl. ..... 60/313; 60/323

[58] Field of Search ..... 60/313, 323

[56] References Cited

U.S. PATENT DOCUMENTS

| | | | |
|---|---|---|---|
| 2,423,602 | 7/1947 | Magdeburger | 60/323 |
| 3,938,330 | 2/1976 | Nakajima | 60/323 |

FOREIGN PATENT DOCUMENTS

| | | | |
|---|---|---|---|
| 41723 | 3/1977 | Japan | 60/323 |
| 108817 | 6/1984 | Japan | 60/313 |
| 132018 | 7/1985 | Japan | 60/313 |

*Primary Examiner*—Douglas Hart

*Attorney, Agent, or Firm*—Brisebois & Kruger

[57] ABSTRACT

An exhaust system for a multi-cylinder internal combustion engine has a tailpipe (13) which is divided by a partitioning wall or walls (14,15) into separate channels extending at least part-way of the tailpipe from its inlet end and with which the outlets of the primary exhaust channels in the manifold are separately connected. The structure of the exhaust system enables the exhaust system to be easily packaged within the engine compartment of a car, while enabling the lengths of the exhaust channels to be selected to enable advantage to be taken of the resonant phenomena for optimization of the engine torque and other engine characteristics.

12 Claims, 6 Drawing Sheets

EXHAUST SYSTEMS FOR MULTI-CYLINDER INTERNAL COMBUSTION ENGINES

Figure 1:
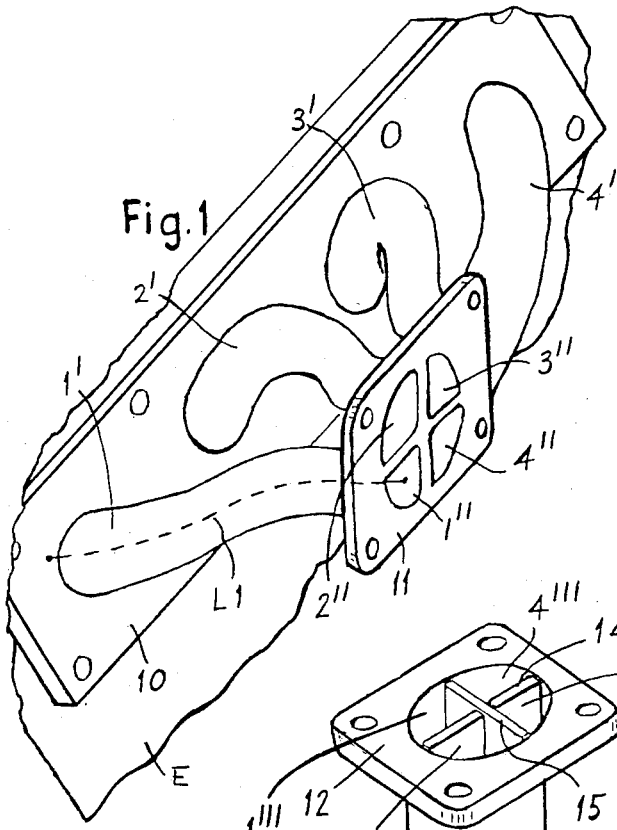

The invention relates to exhaust systems for multi-cylinder internal combustion engines.

It has been known for a long time that what can be called the "resonant length" of the individual exhaust channels of the respective cylinders, that is the length of any individual exhaust channel from the exhaust valve stem (or stems in the case of a four-valve cylinder) of the associated cylinder to the point at which the channel merges with one or more of the other channels has a marked influence on the shape of the engine torque curve and other engine characteristics. For example, it has been found that increasing the length of the individual channels has the effect of obtaining maximum torque at a lower RPM. More generally, the choice of a particular length or lengths for the individual channels assists :n reaching an optimum compromise between the power and torque characteristics of an engine desired for a given application. To obtain optimum results from each cylinder the individual channels should all have approximately the same resonant length.

The exhaust system chosen for most car engines for domestic or public use comprises a compact cast manifold containing individual exhaust channels leading from each exhaust port to an exit face of a flange by which the manifold is connected with one or two steel tailpipes which extend to the lower part of the engine compartment and are then directed towards the rear of the car to connect with a silencer system before discharging into the atmosphere. This system has the advantage of being compact enough to fit into the limited and congested space of the engine compartment of modern cars but restricts the length of the individual or primary exhaust channels of the system.

On a four-cylinder engine, which is the most commonly used in cars today, there are two systems which allow a good compromise to be reached. One of these is the "four-into-one" system, in which all four primary exhaust tubes or channels, constituting a manifold, merge into one tailpipe. To produce a good compromise between maximum power and maximum torque at low RPM for a touring car engine, the length of the primary exhaust tubes or channels has to be very long, of the order of one meter, which cannot be fitted into an ordinary engine compartment. When used it must be dimensioned with much shorter channels and is thus tuned for a higher RPM than would have been desirable. The other system is the "four-into-two-into-one" system, in which the primary channels from cylinders Nos. 1 and 4 are paired into a secondary channel; the primary channels from cylinders Nos. 2 and 3 are similarly paired into a separate secondary channel; and further downstream the two secondary channels are joined together into a single tailpipe which proceeds rearwards to the silencer system. Expansion of the exhaust gases occurs at each junction before final expansion at the open end of the tailpipe and silencer system. Here again for the desired low end torque for a touring car, the overall length of the primary and secondary channels has to be of the order of one meter which again is too long for a practical layout within an ordinary engine compartment.

The theory and technology relevant to these two systems is well known and examined in detail in the literature of the art, for example in "Scientific Design of Exhaust and Intake Systems" by Philip H. Smith, 1963, published by G. T. Foulis & Co. Ltd. (particularly Chapters 5 and 7) and "Gas Flow in the Internal Combustion Engine" by W. J. D. Annand and G. E. Roe, 1974, also published by G. T. Foulis & Co. Ltd. (particularly Chapter 6) and does not require further discussion here. Suffice it to say that the returning rarefaction waves from the expansion points play an important role in influencing the engine power curve, torque curve, fuel consumption and other engine characteristics, the optimisation of which depends upon the application to which the engine is to be put and can be modified significantly by appropriate selection of the length of the exhaust channels.

The invention has for its object to provide an exhaust system for multi-cylinder internal combustion engines which is easy to package within the engine compartment while taking full advantage of the "resonance phenomena" to provide optimisation of engine characteristics for a given application, and a novel tailpipe which enables such an exhaust system to be achieved.

To this end the invention consists in an exhaust system for a multi-cylinder internal combustion engine including a plurality of individual primary exhaust tubes or channels leading from different exhaust ports and connected at their outlet ends into the inlet end of a common tailpipe, characterised in that the common tailpipe is divided by a partitioning wall or walls extending at least part-way along the tailpipe from its inlet end into two or more channels with which the outlet ends of the individual primary exhaust tubes or channels are connected separately or in pairs.

In one embodiment the individual primary exhaust tubes or channels terminate in separate outlets in the exit face of the manifold, where they connect with corresponding channels formed in the tailpipe by transverse partition walls disposed in planes across the bore of and extending at least part-way along the tailpipe. If desired, the transverse walls in the different planes may extend for different distances along the tailpipe so that the channels merge in pairs beyond the shorter transverse wall into secondary channels which again merge at the end of the longer transverse wall into a single channel in the tailpipe.

Thus, by means of the invention, the length of each primary exhaust channel, which may be restricted by reason of the space available in the engine compartment, can be continued to a desired length by primary and/or secondary channels in the tailpipe by the partitioning wall or walls of appropriate length extending from the inlet end of the pipe. The partitioning walls are conveniently made of sheet metal and, for a four-cylinder engine, four channels in the tailpipe may be formed by assembling two strips of sheet metal to form a cross in the bore of the pipe. In the case of a "four-into-two-into-one" exhaust system, the tailpipe need, in some cases, contain only a single strip diametrically dividing the pipe into the two secondary channels of the desired length, or where an extension of the primary channels is required a second transverse strip is provided in the inlet end of the pipe and extends only for the distance required for the four primary channels, the other strip alone extending further to diametrically divide the pipe into the two secondary channels for the required length, whereafter the secondary channels merge into a single pipe. It will be appreciated that the single tailpipe can be bent to facilitate packaging the exhaust system layout in a normal engine compartment and conformed with the design and layout of the engine and other components of a car.

The invention also consists in a tailpipe for the exhaust system of a multi-cylinder internal combustion engine, said tailpipe being provided at its inlet end with means for connecting the tailpipe to connecting means at the outlet of an exhaust manifold comprising a plurality of exhaust tubes or channels disposed to connect with the engine exhaust ports, characterised in that the tailpipe is divided into two channels by a partitioning wall extending at least part-way along the tailpipe from its said inlet end.

The invention further consists in a multi-cylinder internal combustion engine equipped with an exhaust system as herein described.

Figure 2:
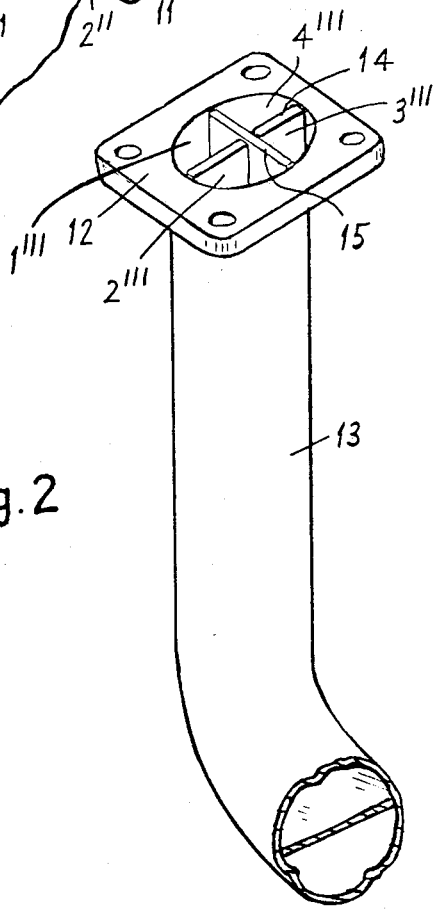
Figure 3:
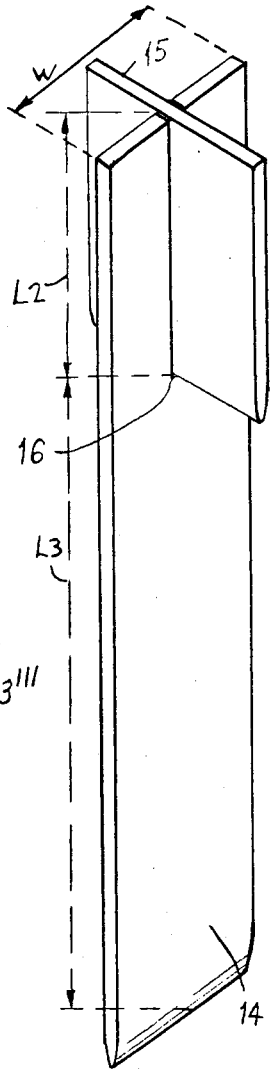
Figure 4:
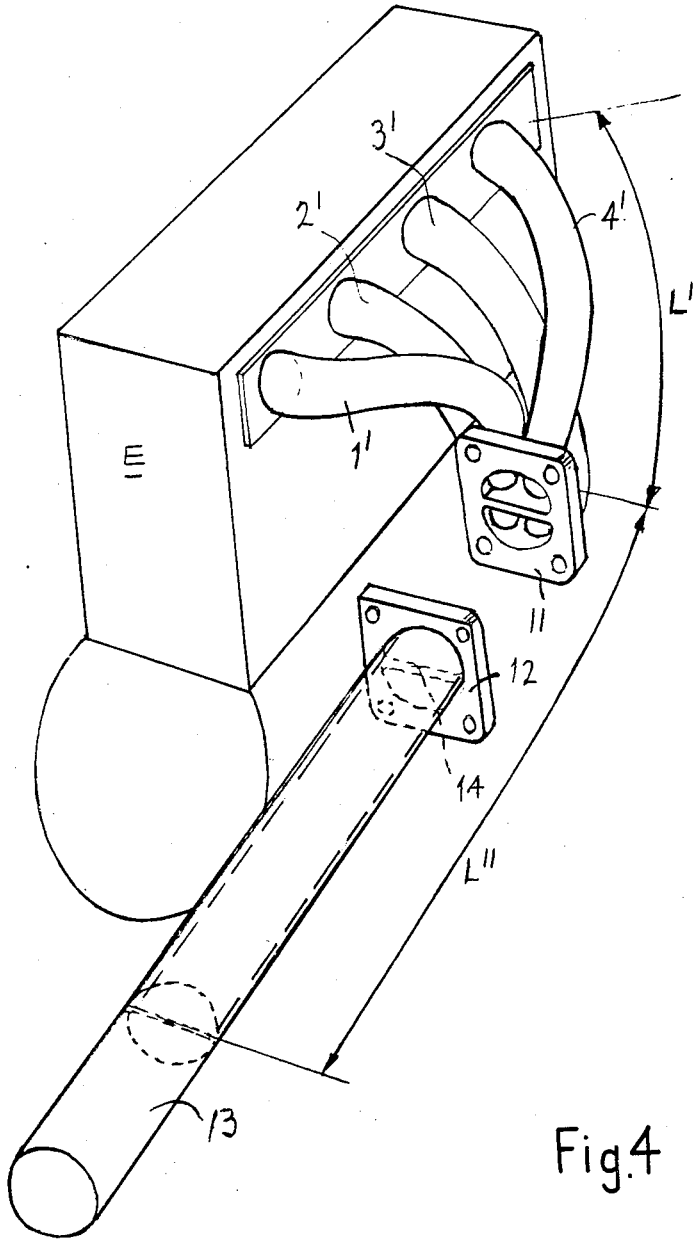
Figure 5:
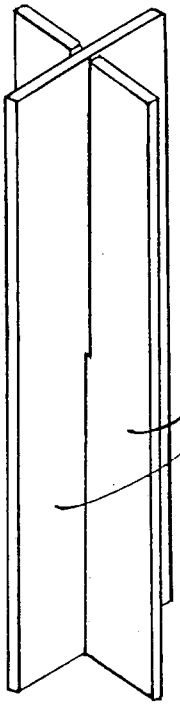
Figure 6:
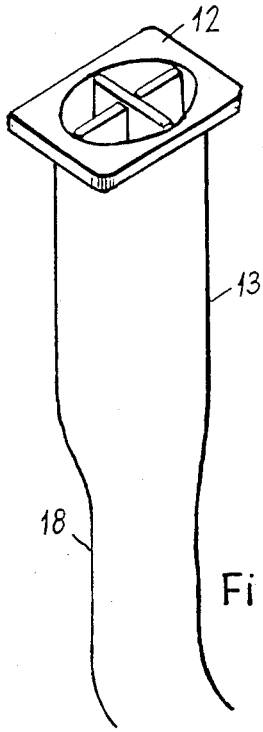
Figure 7:
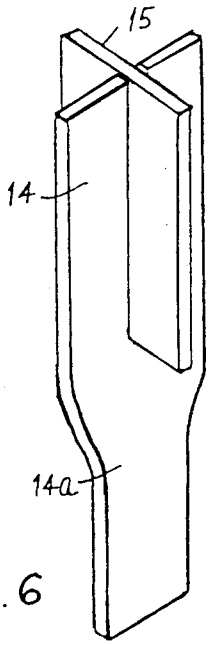
Figure 9:
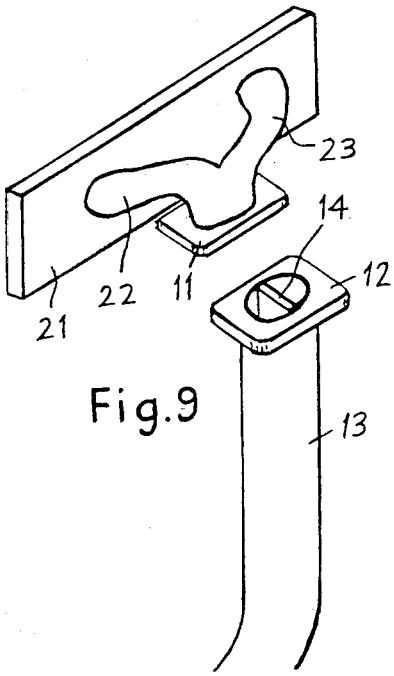
Figure 8:
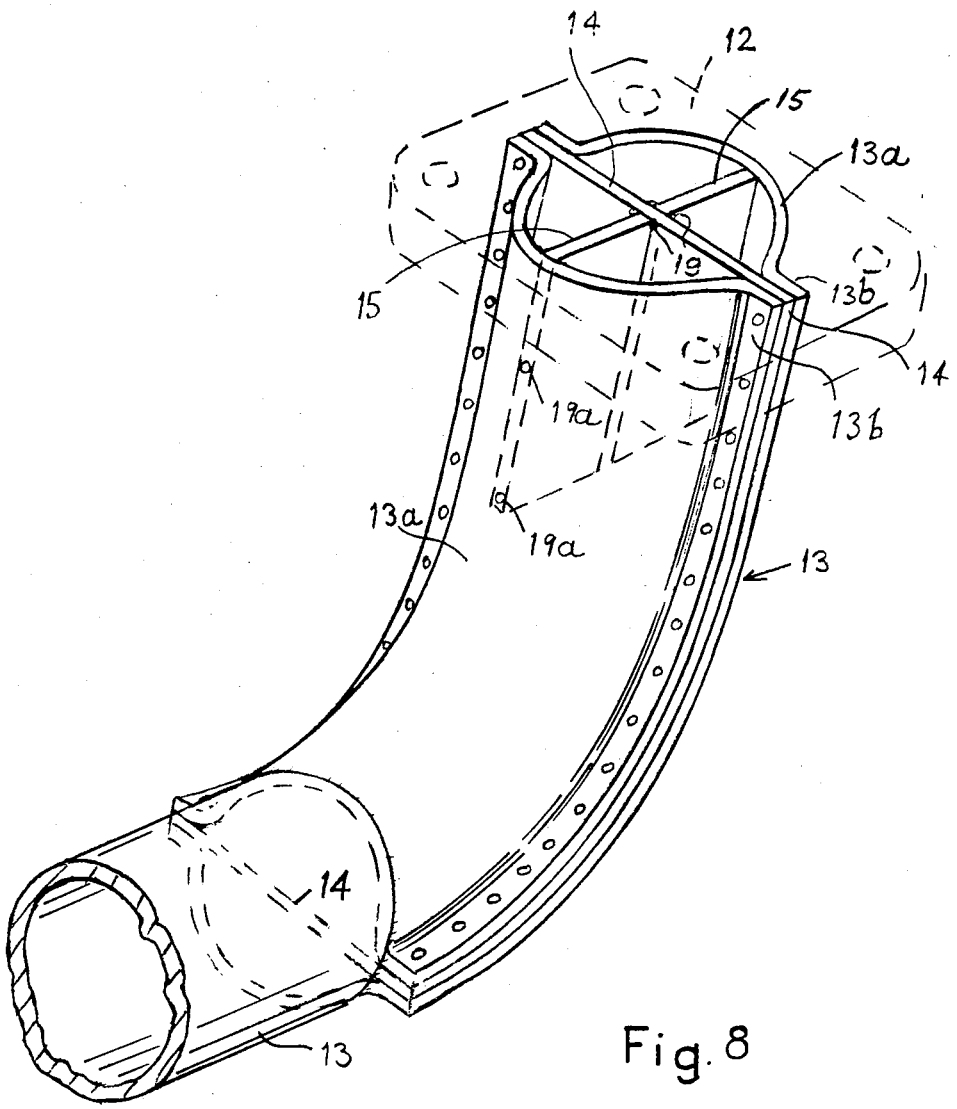

In order that the invention may be more clearly understood, reference will now be made to the accompanying drawings in which:

FIG. 1 is a diagrammatic perspective view of an exhaust manifold according to the invention, FIG. 2 is a perspective view of the inlet end portion of a tailpipe having partitioning walls therein, FIG. 3 is a perspective view of the partitioning wall assembly of FIG. 2, FIG. 4 is a perspective view of a modified exhaust system, FIG. 5 is a perspective view of another partitioning wall assembly, FIG. 6 is a perspective view of the inlet end portion of a tailpipe of profiled shape, FIG. 7 is a perspective view of the partitioning wall assembly of FIG. 6, FIG. 8 is a perspective view of a modified tailpipe construction, FIG. 9 is an exploded perspective view of an exhaust system for a twin-cylinder engine, and of the inlet end portion of the associated tailpipe, FIG. 10 is a modification of FIG. 9 for a four cylinder engine, and FIG. 11 is a perspective view of a three-branch manifold and associated tailpipe.

FIGS. 1 to 3 show an exhaust system of the "four-into-two-into-one" type for a four-cylinder engine. The manifold shown diagrammatically in FIG. 1 comprises four tubular primary exhaust channels 1',2', 3' and 4' of equal length L1 extending from a flange 10 adapted to-be clamped against the cylinder head of the engine E with the inlet ends of the exhaust channels 1' to 4' connecting with the respective exhaust ports in the head. The outlet ends of the exhaust channels terminate in four separate outlet apertures 1", 2",·3" and 4" in the exit face of a flange 11 which is adapted to be clamped to a corresponding flange 12 at the inlet end of a tailpipe 13. In FIG. 1 the exit flange 11 is diagrammatically depicted as tilted outwards in order to show the separate outlets 1" to 4", but in practice the flange 11 would normally be disposed substantially horizontally to fit against the flange 12 at the upper end of the tailpipe 13.

Located in the inlet end of the tailpipe 13 is a partitioning wall assembly comprising two crossed plates 14, 15 of steel or other heat resistant material, as more clearly shown in FIG. 3. Each plate, which may be cut from strip material, has a width W equal to the internal diameter of the pipe 13. The longer plate 14 has a slot 16 cut centrally in its end into which the plate 15 is inserted, thus forming a partitioning wall assembly in the shape of a cross of which the four arms are of equal length and normal to each other. Thus the inlet end of the tailpipe is divided into four equal channels 1''', 2''', 3''' and 4''', of length L2, the walls being so positioned that these channels locate with the corresponding outlets in the exit flange 11 when the flanges 11 and 12 are clamped together. Thereby the four primary exhaust channels 1', 2',3', 4' are extended and primary channels of the desired "resonant length" L1+L2 are formed.

The partitioning plates may be fixed in the tailpipe by welding tacks.

The lower portion of the plate 14 defines the two secondary channels whose length L3 is again chosen for the best functional compromise for the intended use of the car, separating the exhaust stream from cylinders Nos. 1 and 4 from the exhaust stream from cylinders Nos. 2 and 3 until they merge downstream in the tailpipe. The portion of the pipe containing only the plate 14 can, if necessary, be bent in the plane normal to the plane of the plate 14.

FIG. 4 shows an embodiment in which the primary exhaust channels 1' to 4' of length L' merge together in pairs just ahead of two openings in the exit face of the outlet flange 11 of the manifold, and the tailpipe 13 contains a single transverse partitioning wall 14 which, when the flanges 11 and 12 are bolted together, extends the initial part of the two secondary channels in the outlet flange 11 to a total desired length of L".

If the "four-into-one" system be preferred, the partitioning wall assembly of FIG. 2 would be cruciform for the whole of its length as shown in FIG. 5, the two plates 14,15 both being slotted part-way along their lengths.

The tailpipe can be of any cross-sectional form, e.g. circular or square. It may be profiled in known manner so that it becomes smaller in the secondary tract 18 (see FIG. 6) where the lower part of the longer partition plate 14 can be shaped as shown at 14*a* in FIG. 7 to follow the shape of the pipe wall.

In the modification shown in FIG. 8 the tailpipe 13 is fabricated of two part-tubular shells 13*a* having outwardly extending flanges 13*b* which are subsequently joined together in pairs, for example by seam welding, with the edge zones of one of the partitioning walls e.g. plate 14, secured therebetween. The second transverse partitioning wall comprises two pieces of plate 15 welded at 19 to opposite sides of the plate 14, and, if desired, by spot welds, as at 19*a*, to the shells 13*a*. A flange 12 may be secured to the inlet end of the tailpipe. If desired the shells 13*a* may be formed with a curvature, for example through 90°, along a part of their lengths with which the plate 14 will conform when secured between the flanges 13*b*. If the plates 15 also extend into this curved region, they must be cut to the appropriate profiled shape before assembly with the other components of the tailpipe. The exit end of the curved pipe section may be welded to a plain pipe extension leading to the silencer system.

The exhaust system according to the invention can be used for engines having any number of cylinders. For instance for an engine of the twin parallel cylinder layout the manifold 21 (FIG. 9) would have two tubular channels 22, 23 which extend to separate outlets in the exit flange 11 which is clamped to the flange 12 of the tailpipe 13 which is partitioned into two channels by a single plate 14 of the appropriate length.

A four-cylinder engine could, as shown in FIG. 10, be treated as two twins for the purpose of the exhaust system. So the exhaust ports of cylinders Nos. 1 and 4 are connected by two exhaust tubes 22' 23' to a tailpipe 13' with a single partitioning wall 14', whilst the exhaust ports of cylinders Nos. 2 and 3 are connected by two exhaust tubes 22" and 23" to a second tailpipe 13" also with a single partitioning wall 14". The two tailpipes merge at 26 into a common tailpipe extension 13. The two partitioning walls maintain the individual primary exhaust channels separated for the distance L', the remaining length L" of the tailpipes 13' and 13" constituting secondary exhaust channels. The tailpipe extension 13 leads to the silencer system. In a modification the two tailpipes 13' and 13" can, instead of merging together, lead to separate silencer systems or separately to a common silencer system.

FIG. 11 shows an exhaust system for a three cylinder engine, or one half of a six cylinder engine. The three individual exhaust tubes 1', 2' and 3' of a three-branched mainifold terminate in separate openings 1", 2" and 3" respectively in the exit face of the outlet flange 11 of the manifold. The tailpipe 13 is fabricated in a manner similar to that described with reference to FIG. 8 of three part-tubular shells 13*a* of which the flanges 13*b* are welded together in pairs with edge zones of the partitioning plates 14, 15 arranged in the shape of a T secured therebetween as shown to form the channels 1''' 2''' and 3''' constituting extensions of the primary channels 1', 2', 3' when the flange 12 at the inlet end of the tailpipe is secured to the outlet flange 11 of the manifold. The three primary channels merge together in a common tailpipe extension (not shown) welded to the outlet end of the fabricated tailpipe 13.

The invention also makes use of the known "suction effect" which creates a depression in a pocket containing a generally stationary mass of gas when a high velocity gas flow passes the end of the pocket, such as is created in the exhaust channel of one cylinder, whose exhaust valve is closed, by the high velocity exhaust stream in the exhaust channel of another cylinder which entrains into its own stream a part of the relatively stationary gas in the pocket and thereby creates favourable conditions for the exhaust discharge from said one cylinder when its exhaust valve opens. An advantage of the exhaust system of this invention is that the exhaust streams from the different cylinders flow parallel to each other before they mix, thus enabling greater advantage to be taken of the said "suction effect" than in prior exhaust systems in which the exhaust streams merge together in non-parallel directions. To reduce the production of turbulence at the ends of the partitioning walls where the exhaust streams mix and consequential interference with the laminar flow of the exhaust gases can occur, the said ends may be reduced in thickness by tapering as shown in FIG. 3.

Whilst testing on a dynamometer an exhaust system according to this invention as applied to a commercial car engine, it was found that by changing the length of the partitioning walls inside the tailpipe, the point of maximum torque delivered by the engine could be displaced in the RPM range. For instance maximum torque could be obtained at 4000 RPM instead of at 4800 RPM as on the standard engine. While, as usual in exercises involving the resonance phenomena in manifolds, at other points of the torque curve the torque value could be slightly worse, the exhaust system provides an easy way of tailoring the torque curve to the designers wishes by simply lengthening or reducing the length of a partition.

The tests also showed an overall gain in torque at all points between 1000 and 7000 RPM which could only be attributed to the parallel exhaust channels in the tailpipe maintaining the laminar flow at the junction points.

By reason of some or all of the exhaust channels beyond the outlet flange of the manifold being formed by a partitioning wall or walls in a tailpipe, the invention provides an easy to package exhaust system while taking advantage in full of the resonance phenomena by simply varying the lengths of the partitions to achieve optimisation of engine characteristics be to suit the application to which the car is to be put or circumstances existing in the market in which it is to be sold. All these variations can be made with little or no extra tooling.

What is claimed:

1. An exhaust system for a multi-cylinder internal combustion engine having a plurality of exhaust ports leading from different cylinders of the engine, the system including:

a plurality of individual primary exhaust channels, each having an overall length resulting in a predetermined resonant frequency, and each comprising upstream and downstream primary channel portions;

an exhaust manifold arrangement incorporating said upstream primary channel portions, said individual upstream primary channel portions communicating with respective individual outlet openings in an exit portion of said manifold arrangement, and communicating with respective individual exhaust ports of the engine when said manifold arrangement is operatively attached to the engine; and a tailpipe having an inlet end connectable to said exit portion of said manifold arrangement, said tailpipe being bridged internally by at least one partition wall extending generally longitudinally within the tailpipe from said inlet end thereof, said at least one partition wall and surrounding tailpipe together defining said individual downstream primary channel portions, with said at least one partition wall separating and being common to, adjacent downstream primary channel portions, and said at least one partition wall terminating within said tailpipe to define downstream ends of said downstream primary channel portions, whereby said individual downstream primary channel portions extend from said inlet end of said tailpipe and opening at their downstream ends within said tailpipe, and communicate with respective individual outlet openings in said manifold arrangement when said inlet end of tailpipe is operatively attached to said exit portion of said manifold arrangement.

2. An exhaust system according to claim 1, wherein:

said tailpipe includes a bore portion containing said at least one partition wall, said bore portion being generally circular in cross-section;

said at least one partition wall extends diametrically across said bore portion to divide said bore portion into individual complementary downstream primary channel portions which are sector-shaped in cross-section; and said upstream primary channel portions blend into respective complementary sector-shaped outlet openings in said exit portion of said manifold arrangement which match and form effectively uninterrupted continuations of the corresponding inlet ends of said downstream primary channel portions when said tailpipe is operatively attached to said exit portion of said manifold arrangement.

3. An exhaust system for a four-cylinder internal combustion engine according to claim 1, wherein:

said tailpipe includes a bore portion containing said at least one partition wall;

said at least one partition wall comprises at least two transverse partition walls disposed in planes substantially normal to each other across said tailpipe bore portion and extending at least part-way along said tailpipe from its inlet end to form four individual downstream primary channel portions extending from respective openings in said inlet end which are in fluid-flow connection with the respective outlet openings in said exit portion of said manifold arrangement when said tailpipe is operatively attached to said manifold arrangement.

4. An exhaust system according to claim 3, wherein said partition walls in said different planes extends for different distances along said tailpipe bore portion.

5. An exhaust system for a four-cylinder internal combustion engine according to claim 1, wherein said outlet ends of said individual upstream primary channel portions terminate in pairs at two outlet openings in respective exit portions of said manifold arrangement; and two tailpipes are provided, each having an inlet end and a transverse partition wall extending at least part-way therealong from respective openings in its associated inlet end which are in fluid flow connection with the respective outlet openings in said exit portion of said manifold arrangement when said tailpipes are operatively connected to said manifold arrangement.

6. An exhaust system as claimed in claim 5, wherein said two tailpipes are merged together into a common tailpipe extension.

7. An exhaust system according to claim 1, wherein the downstream end zone of said at least one partition wall remote from said inlet end of said tailpipe is reduced in thickness.

8. An exhaust system according to claim 1, wherein:

said tailpipe includes a rectangular cross-section bore portion containing at least one partition wall, said at least one partition wall extends across said bore portion opposite sides to divide said bore into individual complementary downstream primary channel portions which are rectangular in cross-section; and said upstream primary channel portions blend into respective complementary rectangular outlet openings in said exit portion of said manifold arrangement which may match and form effectively uninterrupted continuations of the corresponding inlet ends of said downstream primary channel portions when said tailpipe is operatively attached to said exit portion of said manifold arrangement.

9. An exhaust system according to claim 2, wherein said tailpipe is fabricated of part shells which are joined together along their edges, the edge zones of said at least one transverse partition wall being secured between adjoining edges of said shells.

10. An exhaust system for a multi-cylinder internal combustion engine having a plurality of exhaust ports leading from different cylinders of the engine, the system including:

a plurality of individual primary exhaust channels, each having an overall length corresponding approximately to a predetermined resonant frequency, and each comprising upstream and downstream primary channel portions;

a compact exhaust manifold arrangement incorporating said upstream primary channel portions and inlet and outlet flange means, said individual upstream primary channel portions having upstream ends communicating with respective individual inlet openings in said inlet flange means, and having downstream ends communicating with respective individual outlet openings in said outlet flange means, said inlet openings communicating with respective individual exhaust ports of the engine, and said outlet flange means being disposed in close proximity to the exhaust ports, when said manifold arrangement is operatively attached to the engine; and a tailpipe having inlet flange means connectible to the manifold outlet flange means, said tailpipe being bridged internally by at least one relatively thin, plate-like planar partition wall extending generally longitudinally within the tailpipe from the inlet end thereof, said at least one partition wall and surrounding tailpipe together defining mutually parallel, closely adjacent individual downstream primary chanel portions, with said at least one partition wall separating, and being common to, adjacent downstream primary channel portions, terminating at its downstream end within said tailpipe to define downstream ends of said downstream primary channel portions and terminating at its upstream end at said inlet end of said tailpipe to define upstream ends of said downstream primary channel portions which communicate with respective individual inlet openings in the tailpipe inlet flange means;

said outlet openings in said manifold outlet flange means matching the inlet openings in said tailpipe inlet flange means in shape, size and relative position so that said downstream primary channel portions form effectively uninterrupted, smooth and continuations of the upstream primary channel portions when said tailpipe inlet flange means and said manifold outlet flange means are secured together;

said mutually parallel downstream primary channel portions being separated only by said common at least one partition wall whereby, in operation of the exhaust system, streams exhaust gases discharged from adjacent downstream ends of said downstream primary channel portions flow beyond the end of said at least one partition wall into a common portion of said tailpipe in a generally mutually parallel downstream direction whilst merging together with a reduction in the production of turbulence and interference with laminar flow of the streams of exhaust gases.

11. An exhaust system for a four cylinder internal combustion engine, according to claim 10, wherein:

said tailpipe defines a circular cross-section internal bore portion;

said at least one partition comprises two mutually substantially perpendicular, intersecting, planar partition walls extending longitudinally within diametrically bridging said bore portion to define and mutually separate four complementary quadrant cross-section downstream primary channel portions; and said outlet openings in the manifold flange means are effectively a mirror image of said inlet openings in the tailpipe inlet flange means.

12. An exhaust system for an internal combustion engine having at least one pair of cylinders, according to claim 10, the number of pairs of outlet openings in the manifold flange means and the number of tailpipes corresponding to the number of pairs of cylinders, wherein:

the at least one tailpipe defines a circular cross-section internal bore portion;

said at least one partition wall comprises a single planar partition wall extending longitudinally within and diametrically bridging said bore portion to define and mutually separate two complementary semicircular-section downstream primary channel portions; and said at least one pair of outlet openings in the manifold, outlet flange means are effectively a mirror image of said inlet openings in the inlet flange means of said at least one tailpipe.

* * * * *